US007799283B2

(12) United States Patent
Jacobs et al.

(10) Patent No.: US 7,799,283 B2
(45) Date of Patent: Sep. 21, 2010

(54) HEATING AND COOLING MULTIPLE CONTAINERS OR MULTI-CHAMBER CONTAINERS

(75) Inventors: Merrit N. Jacobs, Fairport, NY (US); Robert Anthony Burkovich, Pittsford, NY (US)

(73) Assignee: Ortho-Clinical Diagnostics, Inc., Rochester, NY (US)

( * ) Notice: Subject to any disclaimer, the term of this patent is extended or adjusted under 35 U.S.C. 154(b) by 0 days.

(21) Appl. No.: 10/988,251

(22) Filed: Nov. 12, 2004

(65) Prior Publication Data

US 2006/0104865 A1 May 18, 2006

(51) Int. Cl.
*B01L 3/00* (2006.01)

(52) U.S. Cl. ..... 422/102; 422/104; 435/388.4; 435/303.1; 219/428; 219/429

(58) Field of Classification Search ..... 422/64, 422/99, 102, 104; 436/47, 48, 157; 435/288.4, 435/303.1, 305.2, 305.3; 219/428, 429
See application file for complete search history.

(56) References Cited

U.S. PATENT DOCUMENTS

| | | | | |
|---|---|---|---|---|
| 4,496,293 | A | 1/1985 | Nakamura et al. | |
| 4,639,135 | A | 1/1987 | Borer et al. | |
| D290,170 | S | 6/1987 | Kayhko | |
| 4,743,561 | A | 5/1988 | Shaffar | |
| 5,475,610 | A * | 12/1995 | Atwood et al. | 700/269 |
| 5,616,301 | A * | 4/1997 | Moser et al. | 422/104 |
| 6,657,169 | B2 * | 12/2003 | Brown | 219/476 |
| 6,767,512 | B1 * | 7/2004 | Lurz et al. | 422/104 |
| 6,906,292 | B2 * | 6/2005 | Weinfield et al. | 219/428 |
| 2003/0003591 | A1 | 1/2003 | LaCourt et al. | |
| 2003/0008286 | A1 | 1/2003 | Zou et al. | |
| 2003/0022380 | A1 | 1/2003 | Jakubowicz et al. | |

FOREIGN PATENT DOCUMENTS

| | | |
|---|---|---|
| DE | 3941168 A1 | 6/1990 |
| EP | 0545736 | 6/1993 |
| WO | WO 01/24930 | 4/2001 |

OTHER PUBLICATIONS

European Search Report, dated Jan. 27, 2006, for European Appln. No. EP 05256989.

* cited by examiner

*Primary Examiner*—Jill Warden
*Assistant Examiner*—Dwayne K Handy
(74) *Attorney, Agent, or Firm*—Todd J Burns

(57) ABSTRACT

A device for heating or cooling multiple single chamber containers or a multi-chamber container. The device includes: a unitary heat or cold source providing a source of heat or cold; heat exchange elements in thermal communication with the heat or cold source and extending away from the heat or cold source; a thermal barrier between each of said heat exchange elements to thermally isolate the heat exchange elements from each other. Each heat exchange element is thermally associated with one or more chambers that are different from one or more chambers associated with other heat exchange elements to thermally isolate the chambers from each other. Preferably the container is a sample or reagent container used in a clinical analyzer, such as a multi-chamber reaction cuvette or a multi-chamber microtiter plate. An incubator assembly, preferably usable in a clinical analyzer, can include the device for heating or cooling.

20 Claims, 4 Drawing Sheets

HEATING AND COOLING MULTIPLE CONTAINERS OR MULTI-CHAMBER CONTAINERS

BACKGROUND OF THE INVENTION

The present invention relates to separately heating and cooling multiple containers or multi-chamber containers. In particular, the present invention relates to heating a sample and/or reagent container in the incubator of a clinical analyzer.

Known analyzers may include an incubator for heating a container, such as a cuvette, having sample and reagent(s) added thereto to a selected temperature, e.g., 37° C., to allow for reaction between the sample and reagent. In many analyzers, multiple cuvettes or multi-chamber cuvettes are used simultaneously to increase sample throughput in the analyzer. An example of a known incubator 10 is shown in FIG. 1. In the incubator shown in FIG. 1, multi-cell cuvettes, such as shown in FIG. 2, are inserted into rows 11. The rows are separated by wall sections 13 that extend from base 12 and are used to transfer heat from the base 12 to the cuvette 20.

Multiple cuvettes or multi-chamber cuvettes (hereinafter collectively referred to as multi-chamber cuvettes), such as those described for example in U.S. Patent Application Publication No. 2003/0003591 A1, Des. 290,170 and U.S. Pat. No. 4,639,135 and shown in FIG. 2, or microtiter plate assay based analyzers do not always fill all of the cuvettes/cells in the same manner. When automated analyzers are used in a random access mode, fluid can be added to cuvette cells which adjoin cells that may be either empty or full. The addition of fluid to these cells can have a large impact on the thermal kinetics of the adjoining cells. For example, in some automated analyzers, reagent is stored on the analyzer at about 8° C. When the reagent is added to the cuvette cell it significantly cools the cuvette cell as well as the surrounding cells.

It is important to prevent or minimize heat transfer between cells because cooling of adjacent cells can negatively affect the reaction between reagent(s) and sample in these cells or have other negative effects, thus affecting the precision of the assays. To reduce or minimize heat transfer, cuvettes have been designed to reduce thermal transfer across the cells. FIG. 2 shows a known multi-cell cuvette 3 having gaps 1 between the individual cells 2 to control the transfer of heat between the cells. FIG. 2 also shows disposable aspirating/dispensing tip 3.

While improved cuvette designs such as shown above have helped with the problem of heat transfer, heat energy can also transfer through the incubator metal parts. This enables the temperature of the fluid in one cell to influence the temperature in the next even if the cuvette design itself completely blocks heat transfer between cells.

In addition to the heat transfer from the addition of cold or hot fluids, there is also detrimental heat transfer that occurs when loading new cuvettes into the incubator. These cuvettes typically enter the incubator at room temperature. The current method for bringing the cuvettes up to incubator temperature is to place the new cuvette into a warm up slot. There is, however, still a temperature influence on the full incubator block when these cold cuvette strips are loaded, because the warm-up slot is generally not thermally isolated from the rest of the cuvette. Another way to reduce the impact of this issue is to pre-heat the cuvettes, however, this adds additional costs to the incubator.

A similar problem occurs in microtiter plates, both when the plate is not fully used, and also at the edges of the microtiter plate. Those cells that are at the boundary, either because there is no fluid in adjacent cells or because they are on the edge, will in a normal incubator design have a faster thermal rise than in the other cells. This can influence the precision of the assays.

In the known microtiter plate art separate heaters and controllers can be used to control each of the cell locations. An example is described in DE 3941168A1. These types of heaters are typically used for polymerase chain reaction ("PCR") processing in microtiter plates. Other types of microtiter plates have an air gap between the cells and the heater plate, such as those used in the Ortho Summit Processor sold by Ortho-Clinical Diagnostics, Inc. Microtiter plate heaters of this type have slower thermal rise times and are thus not as prone to inconsistent heating. That is, the air gap reduces or eliminates thermal cross talk across the heater (although edge effects can still occur). However, the disadvantages of these designs are slower thermal rise times, which results in slow heating. Faster and more controlled thermal rise times make it necessary to implement designs that have more intimate contact with the microtiter plate and therefore are more prone to thermal cross talk.

For the foregoing reasons, there is a need for a device, such as an incubator that has a simplified structure, provides for quicker heating/cooling times and provides increased thermal isolation between cells containing the liquid being heater or cooled.

SUMMARY OF THE INVENTION

The present invention is directed to an apparatus and method that solves the foregoing need for a device for heating or cooling, such as an incubator, and method of using the device that provides a simplified structure, quicker heat up/cool down times and minimal thermal communication between the cells.

One aspect of the invention includes a device for heating or cooling multiple single chamber containers or a multi-chamber container. The device includes: a unitary heat or cold source providing a source, preferably even source, of heat or cold; heat exchange elements in thermal communication with the heat or cold source and extending away from the heat or cold source; a thermal barrier between each of the heat exchange elements to thermally isolate the heat exchange elements from each other. Each heat exchange element is thermally associated with one or more chambers that are different from one or more chambers associated with other heat exchange elements to thermally isolate the chambers from each other. Preferably, the container is a sample or reagent container used in a clinical analyzer, and more preferably, the container is a multi-chamber reaction cuvette or a multi-chamber microtiter plate.

Another aspect of the invention provides a method of thermally isolating multiple single chamber containers or a multi-chamber container. The method includes: providing a device for heating or cooling multiple single chamber containers or a multi-chamber container as described above; heating or cooling the unitary heat or cold source; providing multiple single chamber containers or a multi-chamber container, wherein each heat exchange element is thermally associated with one or more chambers that are different from one or more chambers associated with the other heat exchange elements, and wherein heat flows between the associated heat exchange elements and the one or more chambers without substantially affecting heat flow between the other associated heat exchange elements and chambers.

Another aspect of the invention provides a device for holding and heating a multiple cell cuvette in an incubator assembly. The device includes: a heat source; two or more rows of heat conducting elements in thermal communication with the heat source and extending away from the heat source; and a space between the at least two rows being dimensioned for accommodating a multiple cell cuvette; side walls located at the ends of the rows and extending upward for at least partially the length of the heat conducting elements. Each row of heat conducting elements comprises at least one thermal barrier that extends at partially toward the heat source and prevents or reduces heat transfer between the heat conducting elements.

Yet another aspect of the invention provides an incubator assembly that includes: a device for holding and heating multiple single cell containers or a multi-cell container wherein the device includes: a unitary heat source; heat exchange elements in thermal communication with the heat source and extending away from the heat source; a thermal barrier between each of said heat exchange elements to thermally isolate the heat exchange elements from each other, with each heat exchange element thermally associated with one or more cells that are different from one or more cell associated with other heat exchange elements to thermally isolate the cells from each other; and an incubator housing for containing the device.

Still another aspect of the invention provides a diagnostic analyzer which includes: an incubator assembly described above, wherein the container is a multi-cell reaction cuvette; a multiple cell cuvette, wherein at least one cell has at least one transparent window; and a measuring device for measuring a property of the contents of the cuvette.

Further objects, features and advantages of the present invention will be apparent to those skilled in the art from detailed consideration of the preferred embodiments that follow.

DETAILED DESCRIPTION OF PREFERRED EMBODIMENTS

Figure 1:
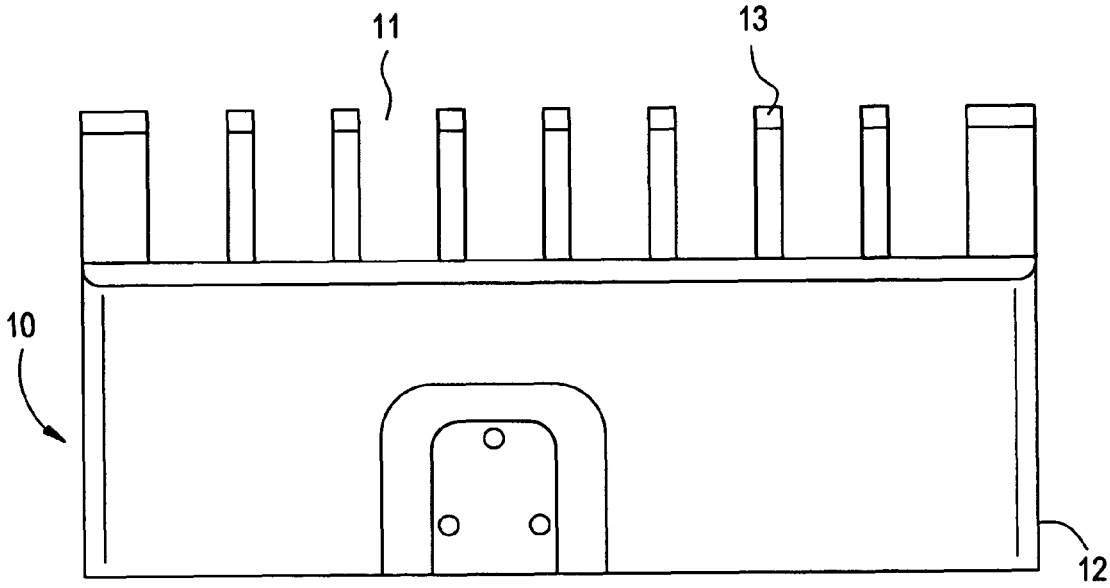
FIG. 1 is a side perspective view of a known incubator for incubating cuvettes such as shown in FIG. 2.

The present invention includes a device for heating or cooling multiple single cell or chamber containers or a multi-chamber/cell container.

As used herein "cell" or "chamber" refers to the compartment that contains a fluid, such as a liquid that is being heated or cooled and are used interchangeably with each other. The cells usable in the present invention can include integral containers having multiple cells, such as the multi-cell cuvette described above in connection with FIG. 2. Alternatively, the cells can be in containers having only a single cell, such as a single cuvette.

In a preferred embodiment, the container is a multi-cell cuvette, which is provided for containing a sample. The cuvette preferably is used in connection with a clinical analyzer. In a preferred embodiment, the cuvette is an open top cuvette adapted for receiving the tip of a pipette or proboscis which dispenses or aspirates sample and/or reagents into the cuvette, such as those described for example in U.S. Patent Application Publication No. 2003/0003591 A1, Des. 290,170 and U.S. Pat. No. 4,639,135, all of which are incorporated by reference in their entireties. Particularly preferred are multi-cell cuvettes having a plurality of vertically disposed reaction chambers side-by-side in spaced relation, each of the reaction chambers having an open top and being sized for retaining a volume of sample or reagent as described in the '591 published application. In another preferred embodiment, the container can be a multi-cell microtiter plate known in the art, such as those used in the Ortho Summit Processor sold by Ortho-Clinical Diagnostics, Inc.

A significant aspect of the present invention is the use of a unitary heat or cold source in combination with heat exchange elements that extend away from the heat or cold source. This design can be applied to any system where precise thermal control need to be maintained and there are boundaries in the device that needs to be controlled. A significant advantage of the present invention provides more uniform passive control without the complexity of multiple active control devices. A preferred embodiment of the present invention also provides a heater system that is easily cleaned and maintained as described more fully below. The unitary heat or cold source provides a uniform source of heat or cold. As used herein, a "unitary heat or cold source" is defined as a heat or cold source that does not individually heat each heat exchange element, such as shown in DE 3941168A1. Instead, a unitary heat or cold source is one that utilizes significantly fewer sources than required for each heat exchange element, preferably only a single source of heat or cold source, which can be applied to a part of the device, such as a metallic block base, other than the heat exchange elements. Use of the unitary heat or cold source provides the advantages described above or being able to forego the complexity of multiple active control device for each heat exchange element.

The unitary heat or cold source can be any suitable structure, for example, a metallic block that can readily transmit heat through the entire structure. This allows the heat or cold to be applied to only partial areas and the high thermal conductivity will evenly distribute the heat or cold to the entire structure. Other suitable materials could include conductive polymers.

Heat or cold can be applied internally to the source, such as through resistance wires running through the block or fluid filled channels in the source. Alternatively, heat or cold can be supplied externally through a surface of the heat or cold source for heat transfer by contact. For example, the source can be a block that sits within the interior of a heating chamber. A preferred method of heating is to attach a heating element that is on a flexible printed circuit heater, such as a Thermofoil™ Heater/Sensor manufactured by Minco Products, Inc. Minneapolis, Minn. The heater is mounted with adhesive to the metallic block. For higher temperature applications, such as PCR type work, the heater could be mounted mechanically. The feedback thermistor is coupled to the heat or cold source using thermal grease.

Heat exchange elements are also included to transmit the heat or cold to the individual cells. An important aspect of the heat exchange elements lies in their thermal communication with the unitary heat or cold source described above. This allows the heat or cold to be transmitted from the source to the heat exchange elements. Thus, it is important that the heat exchange elements are in secure thermal communication with the heat or cold source. If the heat or cold source is metallic, the heat exchange elements can be secured by welding or soldering. Alternatively, the heat exchange elements can secured by fasteners such as bolts or rivets. In a preferred embodiment, the heat exchange elements and heat or cold source can be cast or machined from a single piece of metal.

As noted above, the heat exchange elements are designed to transfer heat from the heat or cold source to the individual cells. In this regard then, the heat exchange elements are preferably at least partially coextensive with the cells to be heated. Preferably, the heat exchange elements are configured such that the heat transferring surfaces of the elements are in face-to-face contact with the surfaces of the cells. Generally, the heat exchange elements and cells of the containers will be in a one-to-one configuration. This provides the greatest possible temperature control for each cell. However, in some embodiments, a single heat exchange element may be dimensioned such that it is in thermal communication with two, three or even more cells. This may be the case where the cells are all filled with liquid at the same time and temperature. Alternatively, a single cell may have two or more heat exchange elements in thermal communication with it. This may be the case where the cell is large and greater than one heat exchange element is needed to effectively transfer heat to/from the cell.

An important feature of the invention is the thermal barrier between each of the heat exchange elements to thermally isolate the heat exchange elements from each other. The thermal barrier prevents the heat (or cold) from one cell from transferring to the other cell via the structure of the device. The dimensions of the thermal barrier have to be sufficient to at least slow down the rate of heat transfer between cells between the heat exchange elements. In a preferred embodiment, the barrier is coextensive with its corresponding or associated heat exchange element. That is, the barrier extends from the base of the heat exchange element where the heat exchange element connects to the heat or cold source to the opposite end of the element. However, it is possible that the thermal barrier extends only partially along the length of the heat exchange element. This is particularly the case in applications where heat exchange between cells is not as critical as other applications. The thermal barriers forces the heat energy to transfer into and from the primary thermal mass of the heat or cold source or block, instead of also transferring between cells or between empty cells via the heat exchange elements.

The thermal barrier may simply be an air gap between the heat exchange elements. In other embodiments, it can be a heat insulating material such as a polymer, e.g. an epoxy or acrylic. Having a thermal barrier that is filled with a solid material (or alternatively, a strip covering the surface of the gap) instead of an open air gap can assist in maintaining the cleanliness of the device. This can be very important in applications where the device is an incubator in clinical analyzers.

In such an application dirt and debris can occlude the read window of a cuvette and affect the precision of the analysis being performed. In addition, a smooth surface with no gaps is desirable because many of the fluids used in a clinical analyzer are bio-hazardous. Also, a smooth, gapless surface assists in maintaining the reliability of the system. This consideration concerns the transport reliability of the cuvettes or microtiter plates. These items are moved into and out of the incubator with a robotic interface and the air gaps can cause the transport to be unreliable because the breaks in the surface caused by the air gaps can be a stubbing or catching point. Any dried fluid on these surfaces will become sticky and also interfere with proper transport of the disposables.

Figure 2:
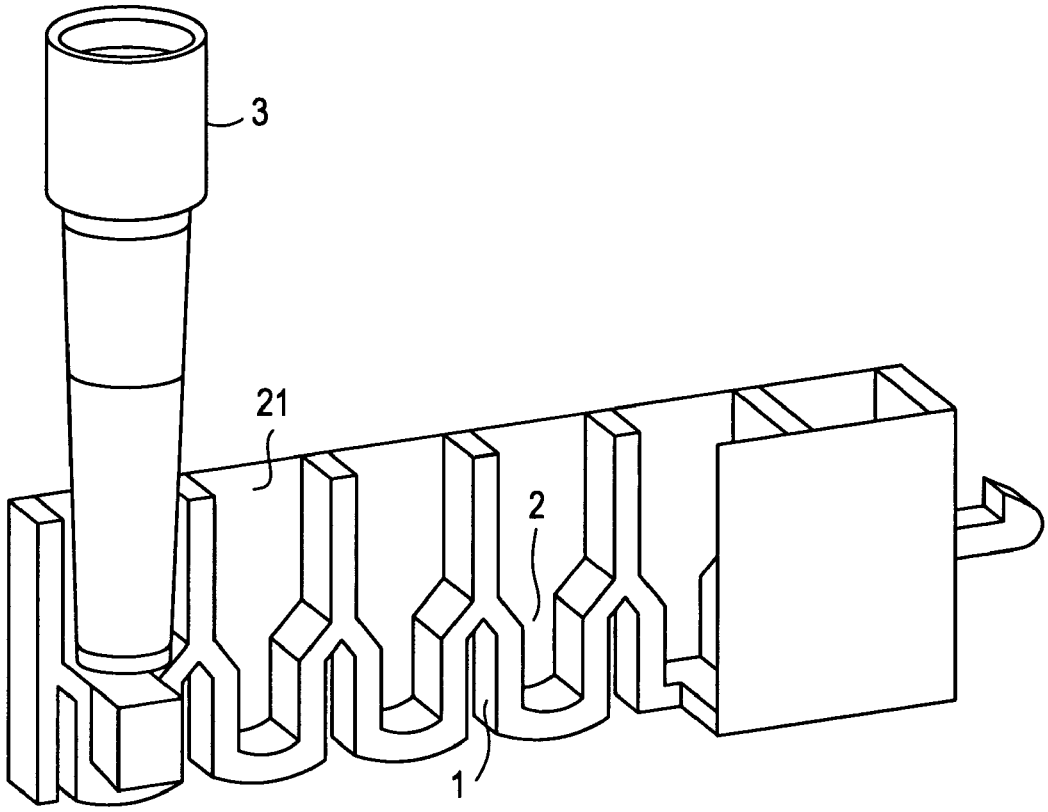
FIG. 2 is a perspective view of a known multi-cell cuvette.

In those embodiments where the container is a multi-cell cuvette such as shown in FIG. 1, the present invention can be an improvement of a known incubator block shown in FIG. 2. The heat exchange elements are formed from the walls extending vertically from the block and separate the multi-cell cuvettes from each other to form eight rows of spaces to hold cuvettes. While eight rows are shown, the number of rows can vary, of course, from one to six, eight, ten, twelve, etc. The thermal barriers can be formed from slots cut into the wall separating the cuvettes to form the heat exchange elements from the wall material remaining after the thermal barrier slots are formed.

In those embodiments where the container is a microtiter plate, the surface of the plate can be modified, such as by machining or etching, to remove material, e.g., metal in areas between the cells to reduce the heat transfer between cells.

The present invention can be applied to any system where precise thermal control needs to be maintained and controlled between boundaries in the device. The present invention can be used for both heating and cooling. The primary advantage is that it enables more uniform passive control without the complexity of multiple active control devices. It also accommodates features that are generically useful in that it enables the heater system to be easily cleaned and maintained.

Systems where improved thermal control is desired include clinical analyzers, such those described in U.S. Patent Application Publication 2003/0022380, published Jan. 30, 2003 and incorporated herein by reference in its entirety. Examples of such analyzers can include chemistry analyzers, immunodiagnostic analyzers and blood screening analyzers. Commercially available clinical analyzers are sold under the trade name, Vitros® 5,1 FS sold by Ortho-Clinical Diagnostics, Inc and Konelab™ 60, sold by Thermo Electron Corporation. In a clinical analyzer, the device of the present invention is configured as an incubator for multi-cell cuvettes. The cells of the cuvette contain a sample to be analyzed. A reagent is added to the sample and a reaction takes place. In most applications, it is very important that the sample be maintained at a constant temperature. After a set period of time a measuring device, such as an optical measuring device is used to pass a beam of light through the cuvette and sample. The result, e.g. absorbance or fluorescence, is measured by a detector of the optical device. Some examples of techniques used to assay analyte in a sample include spectrophotometric absorbance assays such as end-point reaction analysis and rate of reaction analysis, turbidimetric assays, nephelometric assays, radiative energy attenuation assays (such as those described in U.S. Pat. Nos. 4,496,293 and 4,743,561 and incorporated herein by reference), ion capture assays, calorimetric assays, and fluorometric assays, and immunoassays, all of which are well known in the art.

Figure 3:
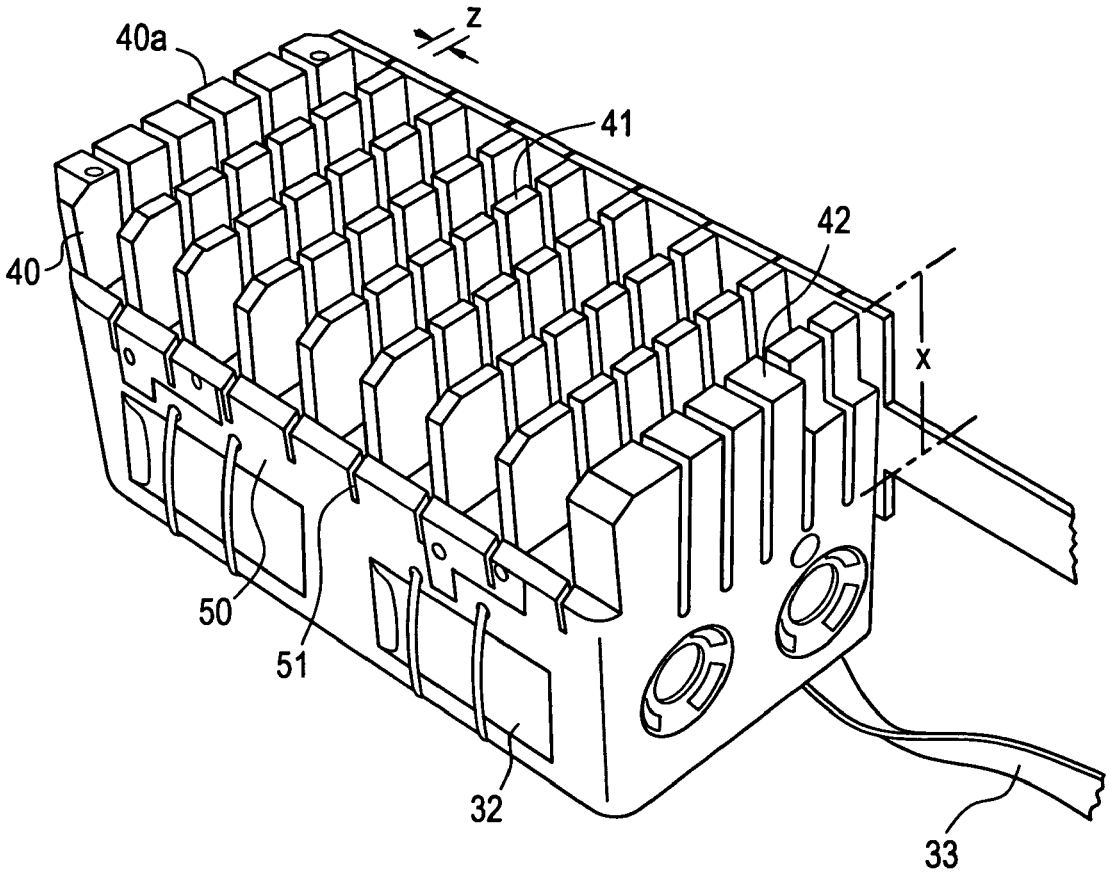
FIG. 3 is a perspective side view of a device for heating or cooling according to a preferred embodiment of the present invention.
Figure 4:
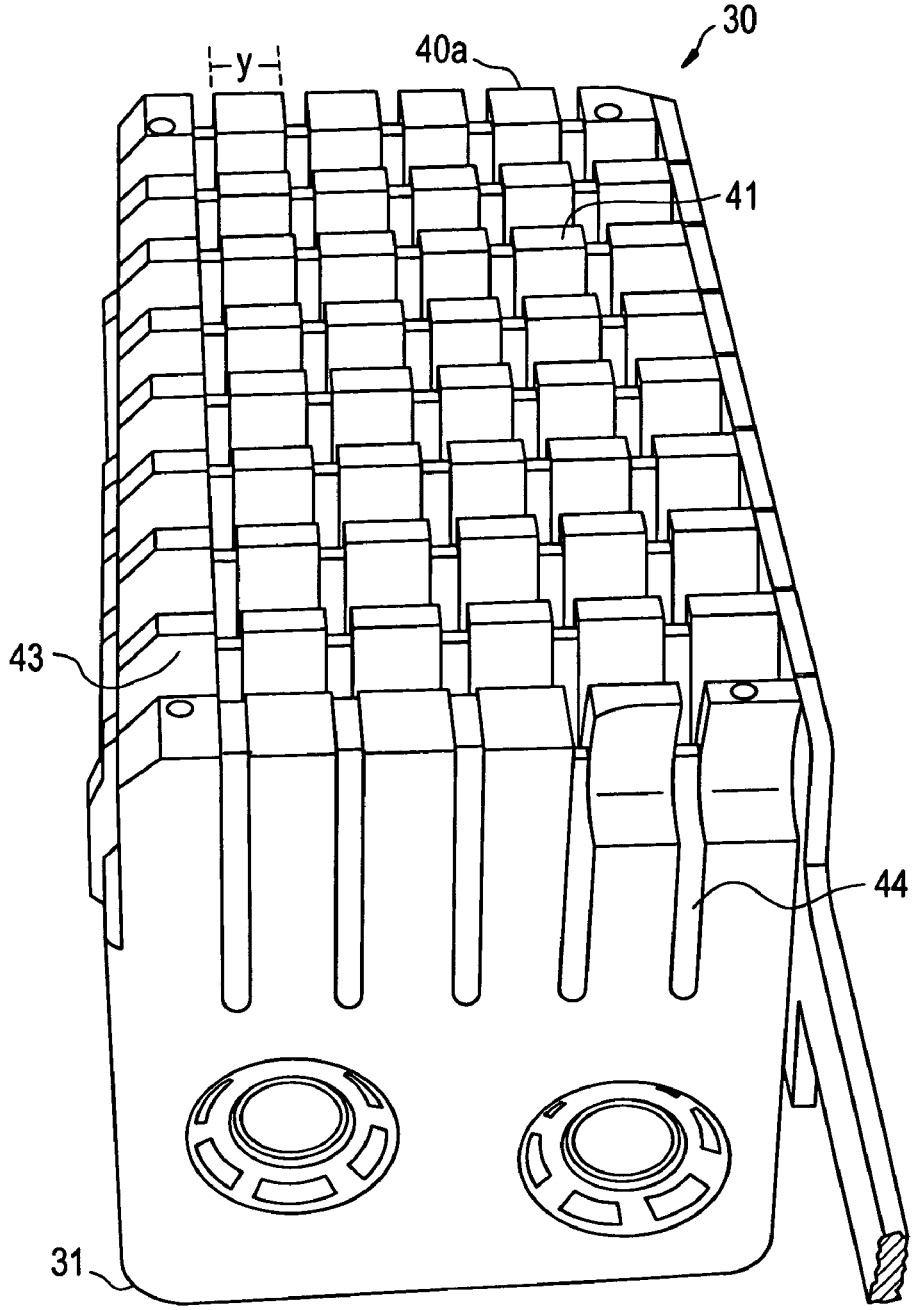
FIG. 4 is a perspective end view of a device for heating or cooling according to a preferred embodiment of the present invention.

Reference will now be made to the preferred non-limiting embodiments shown in FIGS. 3 and 4. FIGS. 3 and 4 show an incubator for multi-cell cuvettes 20, such as those shown in FIG. 2. FIGS. 3 and 4 are substantially identical, except that FIG. 4 shows the gaps between heat exchange elements as having a thermally insulating filler material other than air. The incubator 30 of FIG. 3 is designed to be inserted into a chamber or housing (not shown) for holding the samples in the cells at a constant temperature. The combination incubator and housing forms an incubator assembly. The incubator includes a heat source, which in this embodiment, is a planar, horizontal surface (not shown), which forms the base 31 of the incubator. Heat is supplied via electrical resistance elements 32 which are powered electrical power cord 33. In this embodiment nine rows 40 of heat exchange elements including the end walls 40*a* are provided which results in 8 rows of spaces for the cuvettes 34.

The individual heat exchange elements 41 extend upwardly from the base 31 and extend for a height "x." Height x will preferably be co-extensive with the height of the cuvettes such that the top of the cuvettes will be in line with the top 42 of the heat exchange elements. The cross section of each of the heat exchange elements have major dimension "y"

(FIG. 4) and a minor dimension "z" as shown in FIG. 3. Preferably, the cross-section is substantially rectangular. The surface 43 of the heat exchange element formed by the major dimension is planar and faces the windows 21 of the multi-cell cuvette. Preferably, the surface 43 and windows 21 are in intimate contact with one another to aid in heat transfer.

Located between the individual heat exchange elements 41 are thermal barriers 44. In the embodiments shown in the figures the thermal barriers are formed as slots between the elements. In this embodiment, the slots (barriers) 44 extend down substantially the entire length of the element 41 to provide the greatest protection against thermal transfer between the cells of the cuvette. In the embodiments shown in the FIG. 4, the barriers are filled with a thermally insulative polymer such as an epoxy resin. While the thermal barriers could remain unfilled, thus resulting in lower costs to manufacture, simply having air as the barrier makes the incubator more difficult to keep clean. As discussed above, dirt and particles can interfere with analysis, resulting in imprecise results. Thus, a filled thermal barrier is preferred. The width of the thermal barrier is controlled, in part, by the effectiveness of the heat insulating material, e.g., air or non-conductive polymer, that fills the barrier. Preferably, the insulating material is effective enough that the width of the barrier is less than the minor dimension of the heat exchange element.

As shown in FIG. 3, the incubator also has at sidewalls 50 that extend at least partially up from the base 31. These sidewalls assist in keeping the cuvettes within the incubator. In a preferred embodiment, such as shown in the figures, the sidewalls will also have thermal barriers to reduce the heat transfer between the rows of multi-cell cuvettes. As with the thermal barriers described above, the barriers 51 are preferably filled with an insulating material, such as an epoxy or acrylic polymer.

The methods, particularly the heating or cooling, according to the present invention can be implemented by a computer program, having computer readable program code, interfacing with the computer controller of the analyzer as is known in the art.

It will be apparent to those skilled in the art that various modifications and variations can be made to the compounds, compositions and processes of this invention. Thus, it is intended that the present invention cover such modifications and variations, provided they come within the scope of the appended claims and their equivalents.

The disclosure of all publications cited above are expressly incorporated herein by reference in their entireties to the same extent as if each were incorporated by reference individually.

We claim:

1. A combination comprising: a multiple cell cuvette; and a device for holding and heating the multiple cell cuvette in an incubator assembly for use in a clinical analyzer, the device comprising:

a unitary heat source;

two or more rows of heat conducting elements in thermal communication with the heat source and extending away from the heat source, a space between the at least two rows being dimensioned for accommodating the multiple cell cuvette, wherein the multiple cell cuvette is located in the space between the at least two rows;

side walls located at the ends of the rows and extending upward for partially the length of the heat conducting elements, wherein the space extends the entire length between the side walls;

wherein each row of heat conducting elements comprises at least one thermal barrier that extends at partially toward the heat source and prevents or reduces heat transfer between the heat conducting elements; and wherein the heat source comprises a substantially planar, horizontal surface, the heat conducting elements extend perpendicularly away from the surface, each heat conducting element having a cross-section with a major dimension and a minor dimension, wherein the surface of the heat conducting element having the major dimension is planar, substantially vertical surface facing the space between the two or more rows, and wherein the surface of the element having the minor dimension faces the thermal barrier.

2. A combination as claimed in claim 1, wherein the vertical surface of the heat conducting element is in a face-to-face configuration and abuts a planar surface of a cell of the cuvette.

3. A combination as claimed in claim 2, wherein the height of the heat conducting element is substantially the same as the cuvette.

4. A combination as claimed in claim 2, wherein the cross section of the heat conducting element is substantially rectangular shaped.

5. A combination as claimed in claim 1, wherein the side walls include at least one thermal barrier located between adjacent rows of the two or more rows which extends at least partially toward the heat source and prevents or reduces heat transfer between adjacent rows.

6. A combination as claimed in claim 1, wherein the width of the thermal barrier is less than or equal to the minor dimension of the heat conducting element.

7. A combination as claimed in claim 1, wherein the minor dimension of the heat conducting elements in rows that form end rows are greater than the minor dimension of the heat conducting elements in interior rows.

8. A combination as claimed in claim 1, wherein the heat source and heat conducting elements are metallic.

9. A combination as claimed in claim 8, wherein the heat source further comprises a metallic block and heat generator.

10. A combination as claimed in claim 9, wherein the heat generator is an electrical resistance element in contact with the metallic block which uniformly heats the metallic block.

11. A combination as claimed in claim 10, wherein the heat conducting elements and metallic block are formed from a single piece of metal.

12. A combination as claimed in claim 1, wherein the two or more rows of heat conducting elements comprise four or more rows of heat conducting elements and wherein each row of heat conducting elements comprises two or more thermal barriers.

13. A combination as claimed in claim 12, wherein the thermal barriers are air gaps.

14. A combination as claimed in claim 13, wherein the air gaps are filled with a non-thermally conductive material.

15. A combination as claimed in claim 14, wherein the material comprises an epoxy resin.

16. An incubator assembly comprising:

a combination as claimed in claim 1; and an incubator housing for containing the combination.

17. An incubator as claimed in claim 16, wherein the incubator is in a clinical analyzer.

18. An incubator as claimed in claim 17, wherein the analyzer is a diagnostic analyzer or blood analyzer.

19. An incubator as claimed in claim 16, wherein each cell is associated with a heat exchange element in a one-to-one configuration.

20. A diagnostic analyzer comprising:

an incubator assembly as claimed in claim 16, wherein at least one cell of the multi-cell cuvette has at least one transparent window; and a measuring device for measuring a property of the contents of the cuvette.

* * * * *